US009091006B2

(12) United States Patent
Zheng et al.

(10) Patent No.: US 9,091,006 B2
(45) Date of Patent: Jul. 28, 2015

(54) CONFORMAL COATING OF POLYMER FIBERS ON NONWOVEN SUBSTRATES

(75) Inventors: Yong Zheng, Cary, NC (US); Samana Roy Chowdhury, Raleigh, NC (US); Patrick Vasconcelos Gurgel, Cary, NC (US); Haiyan Liu, Raleigh, NC (US); Ruben G. Carbonell, Raleigh, NC (US)

(73) Assignees: Pathogen Removal and Diagnostic Technologies, Inc., Wilmington, DE (US); North Carolina State University, Raleigh, NC (US)

( * ) Notice: Subject to any disclaimer, the term of this patent is extended or adjusted under 35 U.S.C. 154(b) by 966 days.

(21) Appl. No.: 12/994,403

(22) PCT Filed: Jun. 10, 2009

(86) PCT No.: PCT/US2009/003486

§ 371 (c)(1),
(2), (4) Date: Mar. 22, 2011

(87) PCT Pub. No.: WO2009/151593

PCT Pub. Date: Dec. 17, 2009

(65) Prior Publication Data

US 2011/0268911 A1 Nov. 3, 2011

Related U.S. Application Data

(60) Provisional application No. 61/060,196, filed on Jun. 10, 2008.

(51) Int. Cl.
*D04H 1/56* (2006.01)

(Continued)

(52) U.S. Cl.
CPC ..... *D04H 1/565* (2013.01); *D04H 1/641* (2013.01); *D06M 10/001* (2013.01); *D06M 10/025* (2013.01); *D06M 14/22* (2013.01); *D06M 14/26* (2013.01); *D06M 14/28* (2013.01)

(58) Field of Classification Search
USPC ..... 427/508, 512, 513, 517
See application file for complete search history.

(56) References Cited

U.S. PATENT DOCUMENTS

2004/0242794 A1 12/2004 Kanazawa

FOREIGN PATENT DOCUMENTS

GB 1128696 5/1967
WO 01/34388 A1 5/2001

(Continued)

OTHER PUBLICATIONS

Hawley's Condensed Chemical Dictionary, thirteenth edition, p. 18.*
PCT International Search Report for PCT/US2009/003486 (Jul. 31, 2009).

(Continued)

*Primary Examiner* — Elena T Lightfoot
(74) *Attorney, Agent, or Firm* — LeClairRyan, a Professional Corporation

(57) ABSTRACT

The present invention describes a novel process for the conformal coating of polymer fibers of nonwoven substrates. This process is based on modification of polymer fiber surfaces by controlling the degree of etching and oxidation to improve adhesion of initiators to the surface and to facilitate subsequent conformal polymer grafting. The modified fiber surfaces render new functionalities to the surface, such as increased hydrophilicity, attached ligands or changed surface energy. The invention includes the modified polymer fibers produced by the process described herein.

14 Claims, 16 Drawing Sheets

(51) Int. Cl.

| | |
|---|---|
| ***D04H 1/64*** | (2012.01) |
| ***D06M 10/00*** | (2006.01) |
| ***D06M 10/02*** | (2006.01) |
| ***D06M 14/22*** | (2006.01) |
| ***D06M 14/26*** | (2006.01) |
| ***D06M 14/28*** | (2006.01) |

(56) References Cited

FOREIGN PATENT DOCUMENTS

| | | | |
|---|---|---|---|
| WO | 03/012893 | A2 | 2/2003 |
| WO | 03/049671 | A2 | 6/2003 |
| WO | WO 2006/052548 | A1 * | 5/2006 |

* cited by examiner

A) B) C)

A)

B)

A) B) C)

A) B)

CONFORMAL COATING OF POLYMER FIBERS ON NONWOVEN SUBSTRATES

The present patent application is a national stage application under 35 U.S.C. 371 of PCT/US2009/003486, filed Jun. 10, 2009, and claims the priority of U.S. Patent Application No. 61/060,196 which was filed on Jun. 10, 2008 and which is hereby incorporated by reference.

FIELD OF THE INVENTION

The present invention describes a novel process for the conformal coating of polymer fibers on nonwoven substrates. Specifically, the process is based on the modification of polymer fiber surfaces by controlling the degree of etching and oxidation, which improves adhesion of initiators to the surface and facilitates subsequent conformal polymer grafting. The invention further includes the nonwoven substrates produced by this process.

BACKGROUND OF THE INVENTION

U.S. Pat. No. 5,871,823 [Anders, Hoecker, Klee, and Lorenz] [1] reports using UV light in the wavelength range of 125-310 nm to activate polymer surfaces in the presence of oxygen with a partial pressure of $2\times10^{-5}$ to $2\times10^{-2}$ bar. The activated surface is subsequently grafted. However, this patent is limited to the use of surface hydroperoxides obtained from UV activation to initialize grafting.

U.S. Pat. No. 5,629,084 (Moya, Wilson) [4] discloses a composite porous membrane formed from a porous polymeric substrate and a second polymer which has been crosslinked by heat and UV. The modification of the second polymer is over the entire surface, which is attained by placing a membrane in contact with a second polymer solution and initiator and exposing everything to UV or mild heat in order to crosslink a second polymer on the substrate surface. This scheme can be categorized as a "grafting to" technique where the adsorption of a second polymer to the fiber surface is the critical step.

UV-initialized grafting is generally performed by exposing the substrate to UV light in monomer solutions. It can take place in the range 100-450 nm for a variety of molecules. U.S. Pat. No. 5,871,823 [Anders, Hoecker, Klee, and Lorenz] [1] reported using a preferred UV wavelength in the range 290-320 nm. PCT/WO/02/28947 A1 [Belfort, Crivello and Pieracci] [5] reported using UV wavelengths in the range 280-300 nm. These inventions do not refer to the use of a photosensitizer in the grafting process.

In addition, U.S. Pat. No. 5,468,390 [Crivello, Belfort, Yamagishi] [6] discloses a process to modify polysulfone porous membranes without photosensitizers. As a result, only the outer surface of the membranes described in this reference was modified through the treatment. The polysulfone membranes cannot be rewetted after drying.

U.S. Pat. No. 5,883,150 [Charkaudian] [7] reports that implanting a photosensitizer into the backbone of the polysulfone membrane results in better wetting properties. Nonetheless, it is difficult for most of these implanted photosensitizers to survive the high temperature conditions that are generally used for polymer processing. For example, fiber or nonwoven production with melt-blowing processes requires temperatures above 120° C.

In summary, while surface modification methods such as those described above may generate some coatings on the fiber surface of fiber nonwoven webs or mats, a conformal coating cannot be assured by these methods because they do not provide the necessary means either to overcome possible differences between the surface energies of the substrate and second polymers, or to generate a surface with a high density initiator.

It is, therefore, desired to have a surface modification method which can warrant conformal coating for a wide range of polymer fibers. It is also desired that this method be robust and easy to scale-up. The present invention seeks to meet these and related needs.

SUMMARY OF THE INVENTION

This invention describes a procedure to modify polymer fibers or fiber nonwoven webs or mats to achieve a conformal coating of a different second polymer on the fiber surface by grafting. Conformal coating refers to a coating that conforms to the curvature of the cylindrical or irregular shapes of fibers, thus achieving full coverage of the fibers by a uniform thickness of the grafted polymer. Conformal coatings are required for nonwoven system applications that necessitate complete control of surface properties, such as diagnostics, separations and other applications where the mats are to be exposed to complex mixtures.

The aim of the present invention is to modify polymer fiber surfaces by controlling the degree of etching and oxidization, which significantly improves the adhesion of initiators to the surface, and thus facilitates the subsequent conformal polymer grafting. The modified fiber surfaces render new functionalities to the surface such as increasing hydrophilicity, attaching ligands, or changing surface energy.

The present invention provides an alternative way to use UV activation to initialize grafting from that described in the prior art. While the current invention relies on the utilization of UV as a method to pretreat polymer substrates, it depends on a different effect of UV irradiation. It is well known that UV at certain wavelengths in combination with ozone can etch and oxidize polymer surfaces, leading to higher surface roughness and concentrations of hydroxyl and carbonyl groups [2, 3]. The present invention capitalizes on this effect in order to obtain an enhanced adsorption of initiators and a better contact between the polymer fiber surface and monomer from the solution to achieve a conformal coating. Advantageously, the invention does not rely on hydroperoxide for subsequent grafting. An external supply of ozone is not necessary, as ozone can be generated in air by UV at the same range of wavelength used for etching.

Rather than using a "grafting to" method as are known in the art, the present invention is a "grafting from" method, by which polymer grafts are grown from the substrate surface in a monomer and initiator solution. As the examples will show, without proper pre-treatment, it is impossible to get conformal grafting on certain types of polymer fibers, such as those of polyolefins. This is due to the mismatch of surface energies between the substrate polymer and the second polymer.

In further contrast to what is taught by the prior art, it has been found that in order to achieve a high density conformal coverage on polyolefin fibers, the presence of a photosensitizer or thermally decomposable initiators is/are indispensable, because the invention focuses on polymer nonwovens which are not photoactive. Moreover, it has been observed that peroxide compounds and radicals generated from the pre-treatment step are far less from sufficient to achieve a conformal coating. Therefore, a combination of a photosensitizer and a monomer is necessary for this purpose. However, contrary to the prior art, the photosensitizer is applied only in the monomer solvent at room temperature, which prevents it from decomposing.

Other objects, advantages and features of the present invention will become apparent upon reading of the following non-restrictive description of embodiments thereof, given by way of example only with reference to the accompanying drawings.

DETAILED DESCRIPTION OF THE INVENTION

Figure 1:
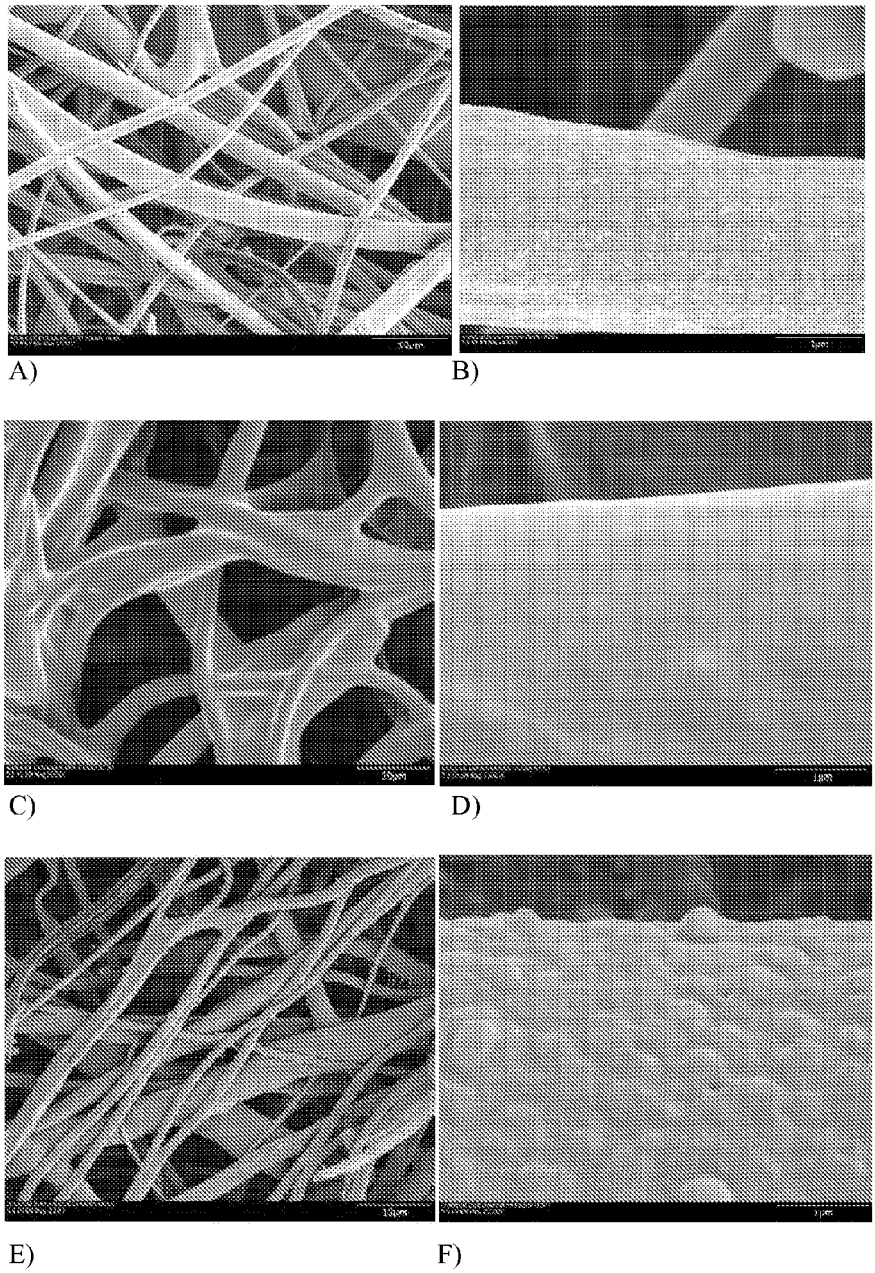
FIG. 1—Polypropylene (PP) nonwoven fibers before and after grafting: A) Original PP nonwoven fibers; B) Surface of an original single PP nonwoven fiber; C) Grafted PP nonwoven before washing; D) Surface of a grafted single PP nonwoven fiber before washing; E) Grafted nonwoven after washing: and F) Surface of a grafted single PP nonwoven fiber after washing.

This invention concerns a process to modify polyolefin (polypropylene) fibers or their nonwoven webs or mats to achieve a conformal coating of a different second polymer on the fiber surface by grafting. The process can also be applied to other polymer fibers, such as, without limitation, cellulose (cotton), polyamide (nylon), polyethylene terephthalate (PET), polybutylene terephthalate (PBT), poly (phenol formaldehyde) (PF), polyvinylalcohol (PVOH), polyvinylchloride (PVC), aromatic polyamid (Twaron, Kevlar and Nomex), polyacrylonitrile (PAN), and polyurethane (PU), among others. The process depends on high density surface grafting polymerization of the second polymer on the fiber substrate. A conformal coating of second polymer on the fiber surface can always be warranted this way because the coverage of the graft on the fiber surface is high and chemical bonds formed between the graft and substrate create a huge energy barrier to prevent coating separation from happening.

The process starts with exposing fibers or their nonwoven web to UV irradiation in the range between 150 to 300 nm in air. During the exposure, ozone is simultaneously generated as a result of $O_2$ exposure to UV light. The objective behind the use of UV irradiation plus ozone treatment in this invention is not to generate radicals or peroxides on the fiber surface. Instead, the goal is to etch the surface to increase its roughness, and simultaneously to increase the concentration of hydroxyl and other oxygen-containing compounds [2, 3]. The combined effect significantly increases the adsorption of initiators in the subsequent grafting step. (See Example 5.)

Polymer fibers may have a smooth or glazed surface, which is the consequence of the fiber production conditions, as the polymer melts or solution passes through a fine nozzle at very high speed. A glazed surface prevents other molecules from attaching to the surface. On the other hand, a rough surface can increase the adsorption of other molecules, such as initiators, to the surface [8-10]. Initiators are molecules that can produce free radicals under mild conditions and initialize radical polymerization reactions. The interactions between polar groups such as hydroxyl and other oxygen containing compounds, and initiators, can further help stabilizing the adsorption [11]. UV irradiation plus ozone is very effective in etching only a very thin layer of the fiber surface to increase its roughness and simultaneously generating hydroxyl and carbonyl groups. Other approaches, such as plasma treatment, peroxide oxidation, base and acid or any method which can increase surface roughness and render oxidization, can also be used for this purpose.

Some polymers are made from monomers which already containing polar groups, such as amines, carbonyls and hydroxyls etc. Initiators may adsorb to these surfaces to such an extent that a conformal coating can be obtained even without pre-treatment. However, for polymer containing only hydrocarbons, e.g. polyolefins, pre-treatment is indispensable for a conformal coating.

After pre-treatment, the functional monomers can be grafted to the surface by free radical polymerization. This process can use UV-initialized radical polymerization or thermally-initialized radical polymerization. Photosensitizers and thermally decomposable initiators should be used in the respective processes. Photosensitizers include benzophenone, anthraquinone, naphthoquinone or any compound involving hydrogen abstraction for initialization. Thermally decomposable initiators include azo compounds or peroxide compounds. The monomer concentration is in the range of 1 to 20%. The initiator concentration is in the range of 0.5 to 7%. Alcohols and hydrocarbons can be used as solvents. The grafting is carried out between approximately 1 and 120 minutes.

Depending on the expected functionalities, a variety of acrylate monomers can be selected for grafting, for example, 2-hydroxylethyl methacrylate, acrylamide, acrylic acid, acrylonitrile, methyl methacrylate, glycidyl methacrylate and similar acrylate derivatives. In addition, any monomer which can be polymerized by radical polymerization can be used for grafting.

A continuous UV irradiation of 300-450 nm is required for UV-initialized grafting. A pre-treated substrate pre-soaked with the solution of monomer and photosensitizer is inserted between two thin glass plates (or a confined geometry) and exposed to UV for a determined amount of time. Confined geometry, forming a saturated vapor phase near the surface of the substrate, has the advantage of preventing fast loss of solvent. The confined geometry also minimizes the grafting solution and allows for the absence of degassing and inert gas protection. Before use, the glass plates may be pre-treated with mold release agents, for example Frekote®.

The grafting can be performed at room temperature or at an elevated temperature, but far below the boiling temperature of monomer solution. Cooling is necessary when solvent evaporates too fast.

An elevated temperature is required for thermally-initialized grafting, where initiators can decompose efficiently. Same confined geometries can also be used.

After grafting, the substrates are washed with appropriate solvents to extract unreacted monomers and unattached homopolymers. Water is a good solvent for monomers and homopolymers which are aqueous soluble. Otherwise, extraction can be done by alcohols, hydrocarbons, or with any other suitable solvent.

In one embodiment, the polymer nonwoven substrate is a flat sheet, a roll or a stack. In another embodiment, the polymer nonwoven substrate is a staple or continuous fiber. For the latter embodiment, the polymer nonwoven substrate has round, triangle, square, or any irregular shapes of cross-sections.

EXAMPLE 1

A specimen of polypropylene (PP) nonwoven 250 μm thick and of dimensions 2×4 cm was exposed to UV irradiation of 150 to 300 nm (UV/O) and intensity 50 mw/cm$^2$ for 15 minutes. The substrate was then soaked with 20% glycidyl methacrylate and benzophenone (Initiator:Monomer or I:M=1:25) in butanol solution. The substrate was sandwiched between two glass slides coated with Frekote®, and then exposed to UV of 300 to 450 nm and intensity 5 mw/cm$^2$ for 15 minutes for grafting. The grafted nonwoven substrate was then washed by sonication in THF and methanol to remove unreacted and unattached compounds.

FIGS. 1A) and B) show the original PP nonwoven web and fiber. The surface of the original PP fiber is covered with cracks as a result of melt-blown process. FIGS. 1C) and D) show the nonwoven web and fiber after grafting, but before washing. Very smooth coatings are formed on the fibers. However, these coatings are not permanent. FIGS. 1E) and F) show the nonwoven web and fiber after washing. A high density coarse polyglycidyl methacrylate (PGMA) coating is covalently attached to the fiber surface. The porous structure of the web has not been changed.

Figure 2:
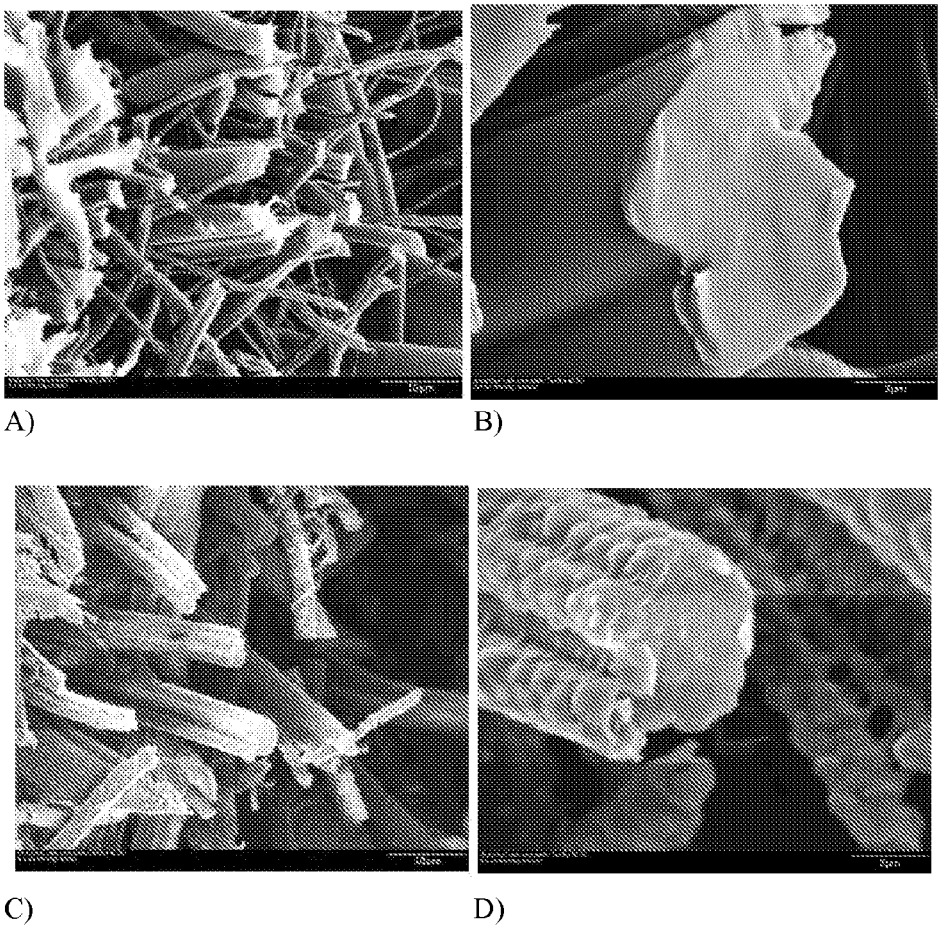
FIG. 2—Cross sections of PP nonwoven fibers before and after grafting: A) Original PP nonwoven fibers; B) Cross section of an original single PP nonwoven fiber; C) Grafted PP nonwoven fibers; and D) Cross section of a grafted single PP nonwoven fiber.

FIGS. 2A) and B) show the cross-sections of the original PP nonwoven web and fiber. FIGS. 2C) and D) show the cross-sections after grafting. As it may be seen, the grafting is very conformal to the cylindrical and even irregular shaped fibers. The thickness is difficult to measure due to low contrast between the coating and fiber. It is estimated at between approximately 100 and 200 nm.

Figure 3:
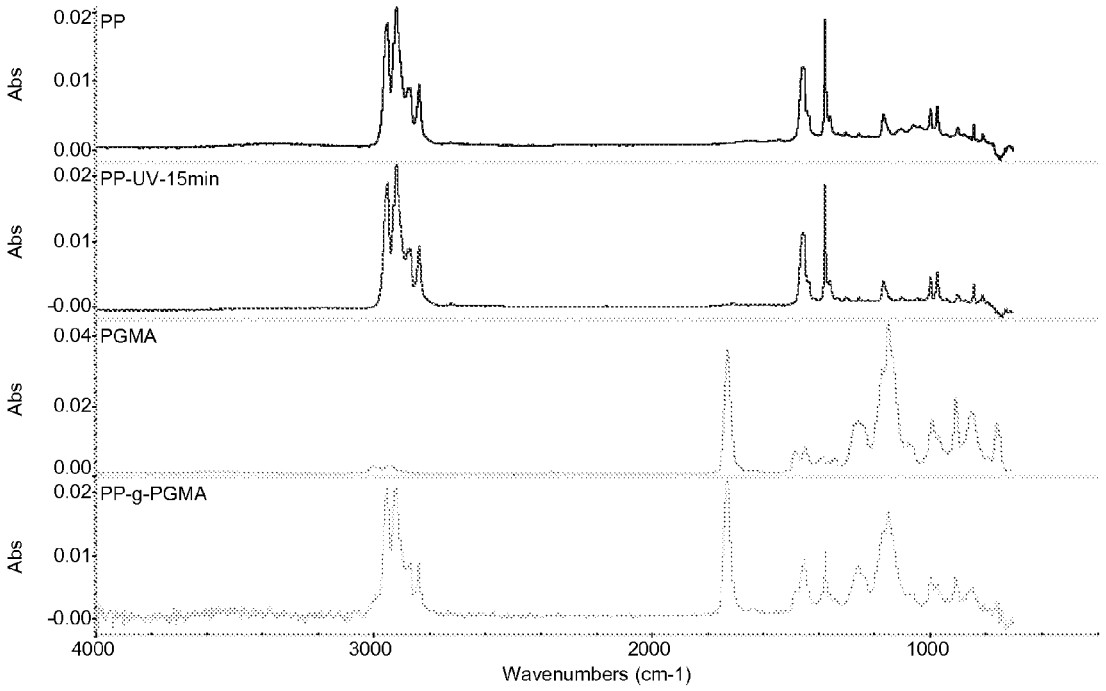
FIG. 3—FTIR of original PP, UV pre-treated PP, pure polyglycidyl methacrylate (PGMA) and PGMA-grafted PP.

FIG. 3 shows the FTIR spectra of original PP, UV-pre-treated PP, pure PGMA and PGMA-grafted PP. The characteristic peak at 1720 cm$^{-1}$ on the grafted nonwoven is a clear evidence of PGMA grafting.

EXAMPLE 2

Figure 4:
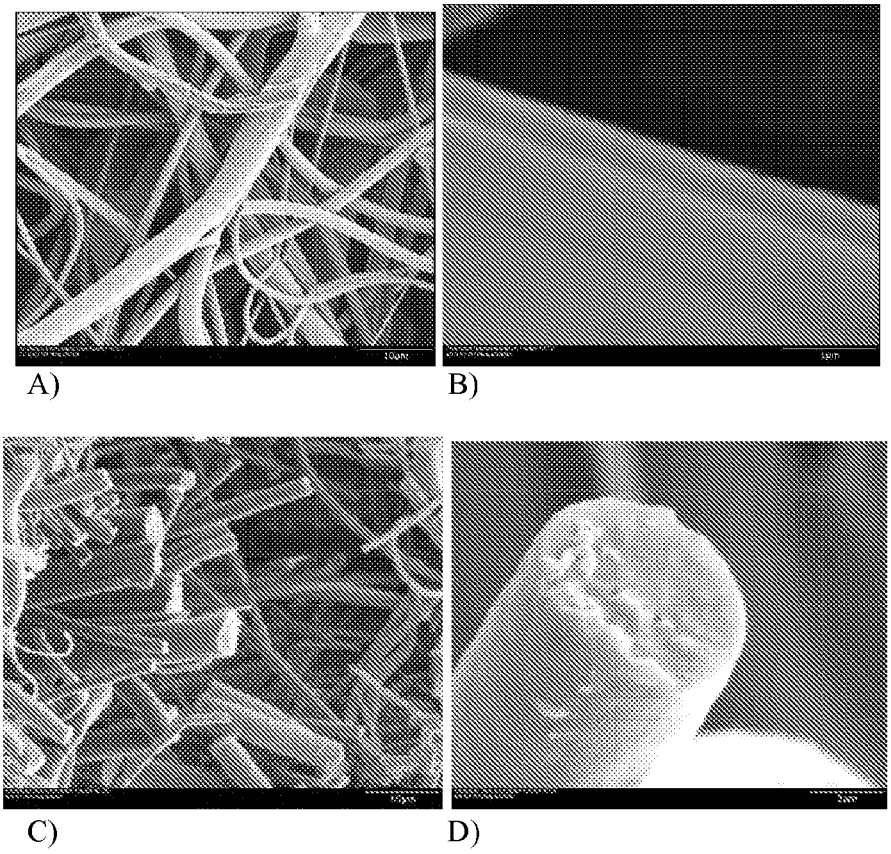
FIG. 4—PP nonwoven grafted at I:M=1:5: A) Grafted PP nonwoven fibers; B) surface of a grafted single PP nonwoven fiber; C) Cross section of PP nonwoven fibers; and D) Cross section of a grafted single PP nonwoven fiber.

Grafting results shown in FIG. 4 were from the same process producing FIGS. 1E) and F) in Example 1, except that in Example 2 the benzophenone to monomer ratio (I:M) was 1:5. The results in FIG. 4 clearly indicate that this technique can change the morphology of the coating from very coarse to very smooth by simply adjusting the benzophenone to monomer ratio.

EXAMPLE 3

Figure 5:
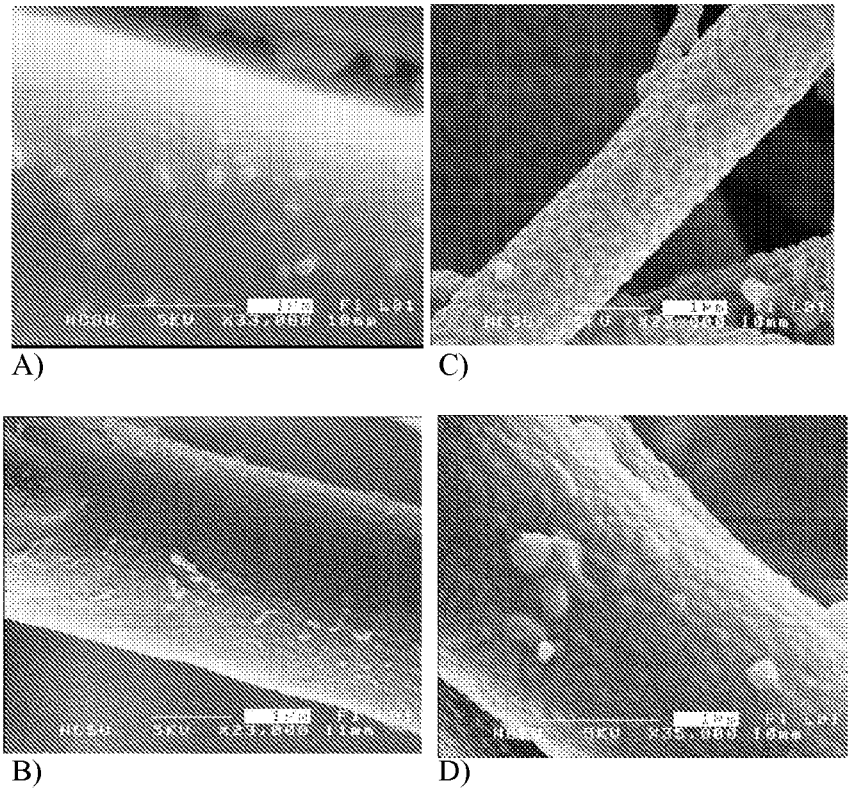
FIG. 5—SEM images of PGMA grafted PP fibers after 0-30 minutes of UV/O treatments: A) Zero (0) minutes; B) Five (5) minutes; C) Fifteen (15) minutes; and D) Thirty (30) minutes.

Four specimens of polypropylene nonwoven 250 μm thick and of dimension 2×4 cm were exposed to UV irradiation of 150 to 300 nm and an intensity of 50 mw/cm$^2$ for 0, 5, 15 and 30 minutes, respectively. The pre-treated samples were then grafted with PGMA in the same way as in Example 1. FIG. 5 indicates that both density and conformity of PGMA graft increase with the time of UV/O treatment.

EXAMPLE 4

Figure 6:
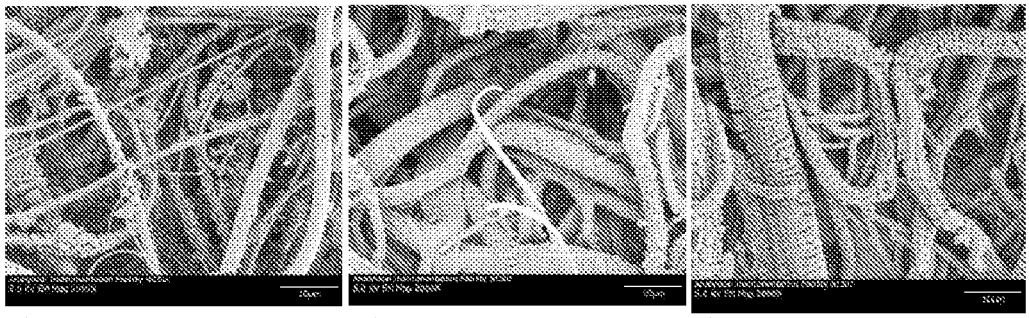
FIG. 6—SEM Images of PGMA grafted PP nonwoven webs after 0, 15 and 30 minutes pre-treatment and the same 30 minutes grafting: A) Zero (0) minutes; B) Fifteen (15) minutes; and C) Thirty (30) minutes.

Three specimens of polypropylene nonwoven 250 μm thick and of dimension 2×4 cm were exposed to UV irradiation of 150 to 300 nm and intensity 50 mw/cm$^2$ for 0, 15 and 30 minutes, respectively. The pre-treated samples were then grafted with PGMA in the same way as Example 1, except the grafting time was 30 minutes for this example. Approximately twice as much grafting as that for 15 minutes was obtained. However, an increase in grafting efficiency does not necessarily increase the conformity of the graft. In FIG. 6, without pre-treatment, the grafting is not conformal to the fibers, which is in contrast with conformal grafting after 15 minutes and 30 minutes pre-treatment.

EXAMPLE 5

Adsorption of benzophenone on the PP fiber surface as a function of UV/O pre-treatment time was measured by the following procedure. The samples were first pre-treated for designated periods. Then, they were immersed into a 1.3% (w/w) benzophenone in butanol solution absent of UV irradiation. The concentration of benzophenone was the same as that used in the 20% grafting solution, and the immersion times were 1, 10, 15 and 30 minutes. After immersion, the samples were taken out, hard-pressed between two paper towels (Wypall® X60, Kimberley Clark) to remove the solution trapped in the pores, dried in air and analyzed by FTIR-ATR.

Figure 7:
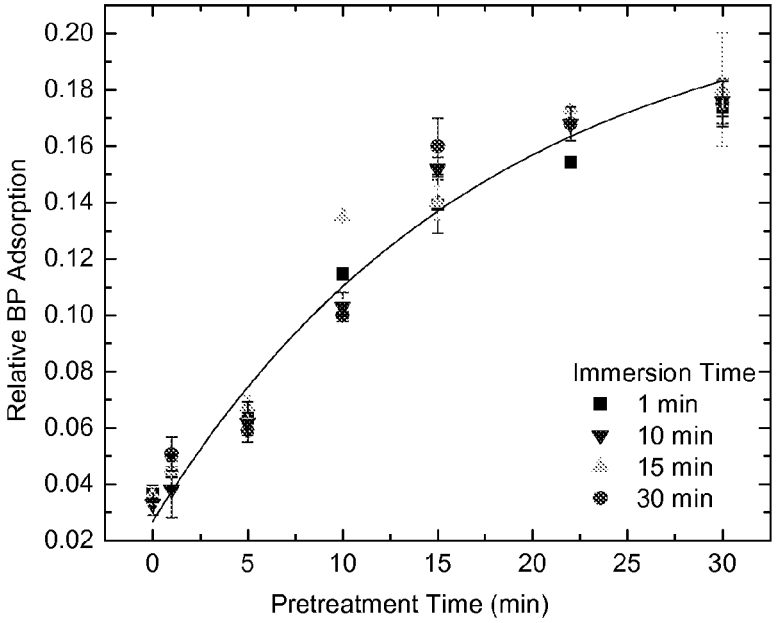
FIG. 7—Relative benzophenone (BP) absorption as a function of UV pre-treatment time measured at different immersion times.

In FIG. 7, relative BP adsorption values are plotted as a function of pre-treatment time. The standard error was estimated from data measured at different spots on the same specimen. The adsorption curves clearly indicate that BP adsorption increases with UV/O pre-treatment time. This can be explained as the result of increased roughness and concentration of hydroxyl groups from pre-treatment. Furthermore, regardless of various immersion times, adsorption curves collapse into a single curve within the experimental error. This implies that upon contacting BP solution, equilibrium of BP was quickly established between the solution and the fiber surface.

Since grafting density depends on the initiator density on a substrate, PP nonwoven pre-treated with UV/O leads to deeply enhanced conformity of the graft.

EXAMPLE 6

Specimens of polypropylene (PP) nonwoven 250-μm thick and of dimensions 2×4 cm were exposed to UV irradiation of 150 to 300 nm (UV/O) and intensity 50 mw/cm$^2$ for 0 to 15 minutes. The specimens were then soaked with 20% glycidyl methacrylate and benzophenone (I:M=1:25) in butanol solution, sandwiched between two glass slides coated with Frekote®, and then exposed to UV of 300 to 450 nm and intensity 5 mw/cm$^2$ for grafting of various durations. The grafted nonwoven substrate was washed by sonication in THF and methanol to remove unreacted and unattached compounds.

Figure 8:
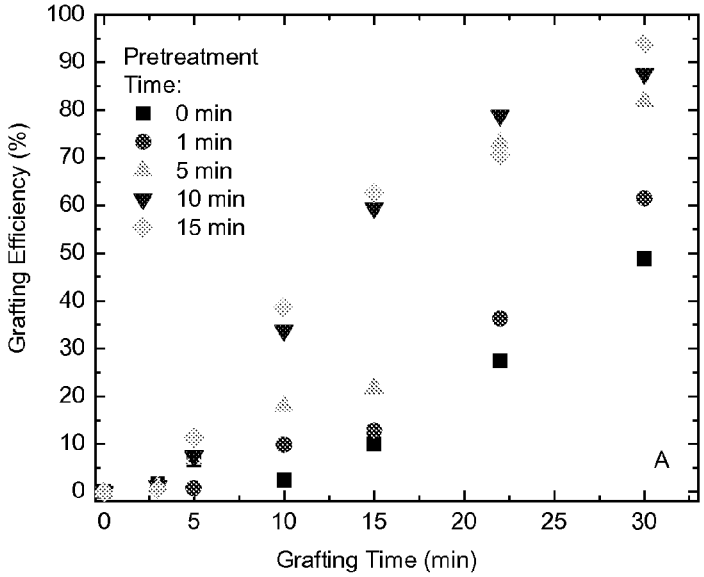
FIG. 8—Comparison of grafting efficiencies: A) Grafting efficiency as a function of grafting time for samples at different pre-treatment times; and B) Grafting efficiency as a function of BP adsorption at different grafting times.
Figure 8:
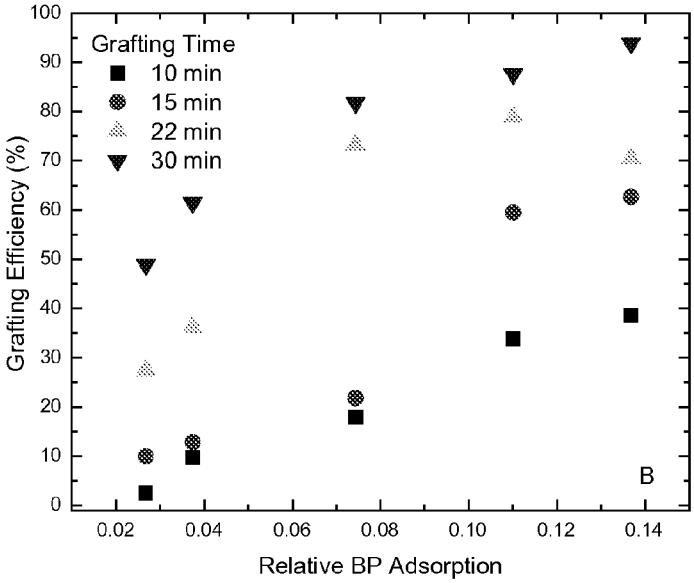

FIG. 8A) shows that the grafting rate increases with the pre-treatment time. The increases are due to the initiator density or the adsorption of benzophenone on the fiber surface which increases with the pre-treatment time. High initiator density leads to more grafting sites on the surface. Therefore, the overall grafting rate is higher. It is also interesting to note that all the samples show a lag period of ~5 minutes. This lag period is presumably from the trapped oxygen in the system which can delay the starting of the grafting. In addition, the curves for 10 and 15 minutes pre-treatments overlap with each other. This suggests that they have similar grafting rates despite their difference in initiator density. It has been hypothesized that not all the initiators on the surface are used for initializing graft because they are inhibited by steric effects from nearby grafts [12]. Therefore, there exists a cut-off initiator density, and the grafting rate increases little beyond that density.

FIG. 8B) shows the grafting efficiencies measured at constant grafting times as a function of BP adsorption. Grafting efficiencies show a strong dependence on low initiator densities, but weak dependence on high initiator densities. The cut-off density lies around a relative BP adsorption of 0.08.

EXAMPLE 7

Specimens of polypropylene (PP) nonwoven 250 μm thick and of dimensions 2×4 cm were exposed to UV irradiation of 150 to 300 nm (UV/O) and an intensity of 50 mw/cm$^2$ for 0 to 15 minutes. The specimens were then soaked with 10, 15 or 20% glycidyl methacrylate and benzophenone (1:M=0 to 1:4) in butanol solution, sandwiched between two glass slides coated with Frekote®, and then exposed to UV of 300 to 450 nm and intensity 5 mw/cm$^2$ for grafting of various durations. The grafted nonwoven substrate was washed by sonication in THF and methanol to remove unreacted and unattached compounds.

Figure 9:
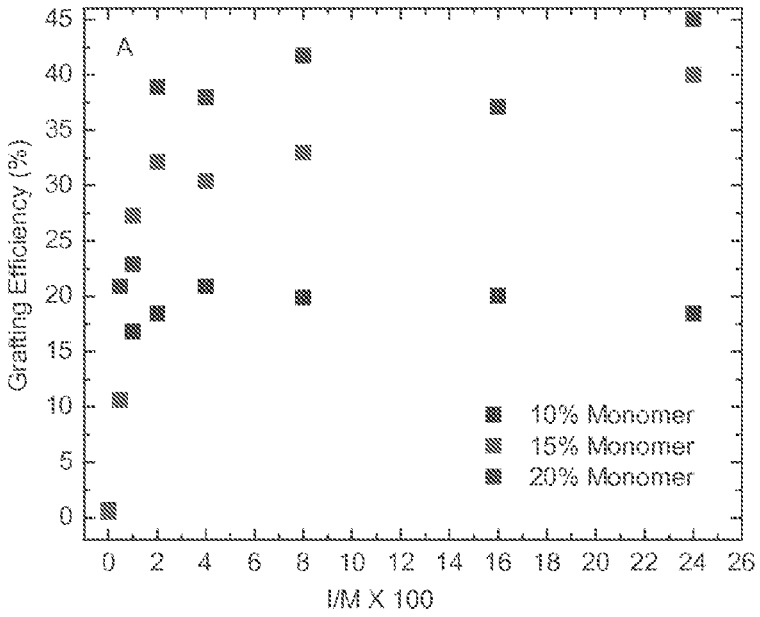
FIG. 9—Influence of monomer and initiator concentration on grafting efficiency.

Grafting efficiencies at three monomer concentrations are plotted. For each concentration, the ratio between initiator to monomer was varied from 0 to 24%. As shown in FIG. 9, the grafting efficiency increases rapidly at low initiator to monomer ratios (I:M) for all three monomer concentrations. When the ratio is above 2%, grafting efficiency reaches a plateau. The independence of grafting efficiency on the initiator is due to the fact that the initiator density on the fiber surface for these initiator concentrations is already above the cut-off BP density. Further increase of the initiator induces little change on the grafting efficiency.

EXAMPLE 8

Figure 10:
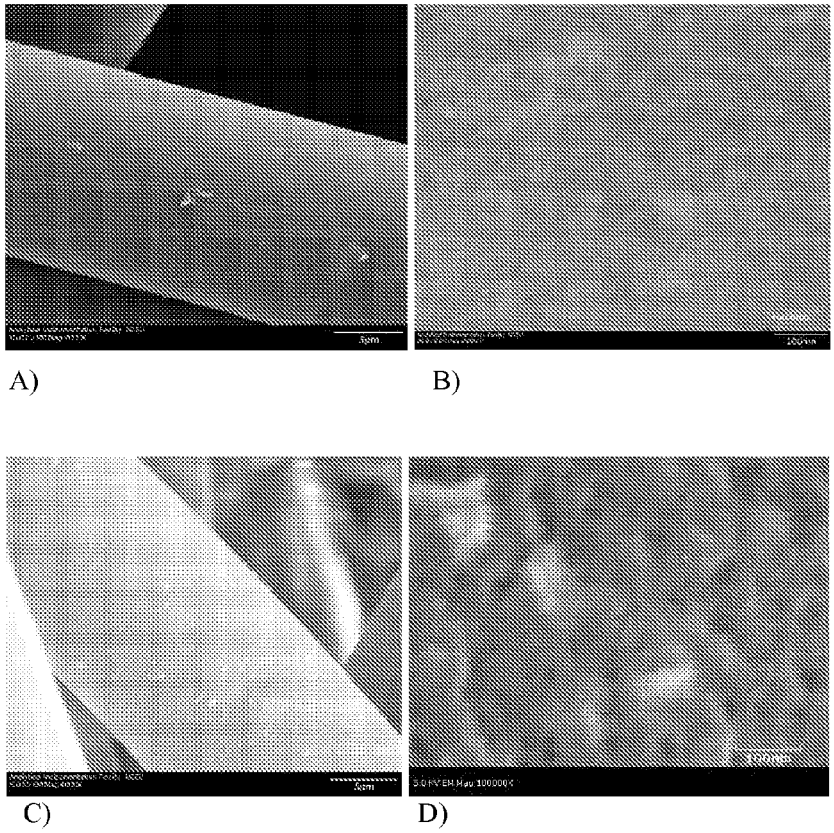
FIG. 10—Nylon nonwoven fiber before and after grafting: A) A single original nylon nonwoven fiber; B) Surface of an original nylon nonwoven fiber; C) A single grafted nylon nonwoven fiber; and D) Surface of a grafted nylon nonwoven fiber.

A specimen of nylon-6, 6 nonwoven 140 μm thick and of dimensions 2×4 cm was exposed to UV of 150 to 300 nm and intensity 50 mW/cm$^2$ for 15 minutes (UV/O). The substrate was then soaked with 20% glycidyl methacrylate and 1.3% benzophenone solution with butanol as solvent. The substrate was sandwiched between two glass slides coated with Frekote®, and then exposed to UV of 300 to 450 nm and intensity 5 mW/cm$^2$ for 15 minutes. The grafted nonwoven substrate was then washed by sonication in THF and methanol to remove unreacted and unattached compounds. FIG. 10 shows that conformal grafting has been formed on the nylon fiber. Even though the surface energy of nylon is very different from PP, the same technique can generate conformal grafting for both materials.

EXAMPLE 9

Figure 11:
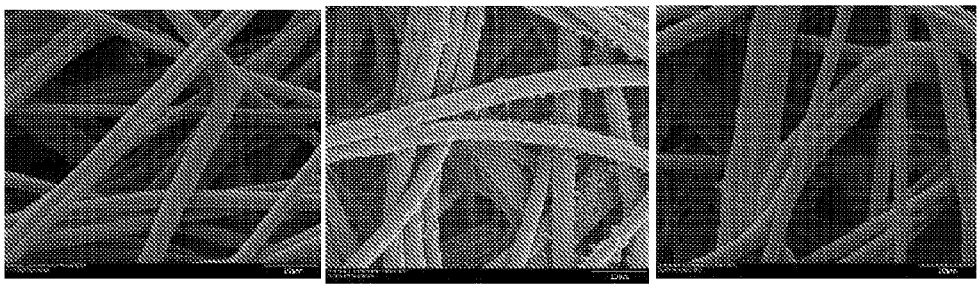
FIG. 11—Grafting on PBT nonwoven web with and without pre-treatment: A) Original PBT nonwoven; B) Grafted PBT nonwoven with pre-treatment; and C) Grafted PBT nonwoven without pre-treatment.

A specimen of polybutylene terephthalate (PBT) nonwoven 160 μm thick and of dimension 2×4 cm was exposed to UV of 150 to 300 nm and intensity 50 mW/cm$^2$ for 15 minutes. Another specimen was not pre-treated at all. Both substrates were then soaked with 20% glycidyl methacrylate and benzophenone (I:M=1:25) in butanol solution. The substrate was sandwiched between two glass slides coated with Frekote®, and then exposed to UV of 300 to 450 nm and intensity 4 mW/cm$^2$ for 15 minutes. The grafted nonwoven substrate was then washed by sonication in THF and methanol to remove unreacted and unattached compounds. FIG. 11 shows that PBT fibers on the nonowoven have been grafted with high density and conformal PGMA graft. Without pre-treatment, conformal grafting can still be formed on the PBT fibers. This is due to the fact that PBT is more polar than PP, and dipole-dipole interactions between benzophenone and PBT improve its adsorption. As a result, a high density of initiator can be obtained even without pre-treatment.

EXAMPLE 10

Figure 12:
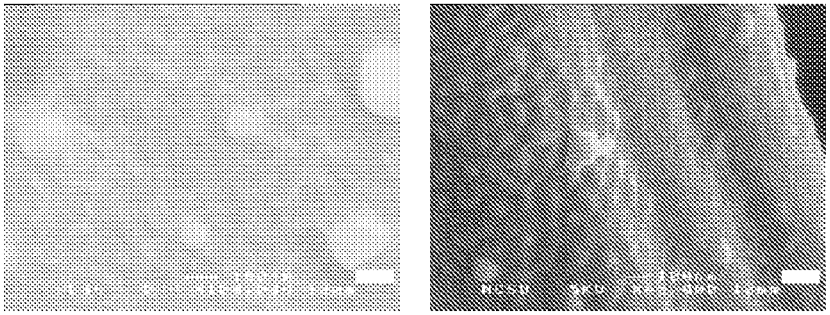
FIG. 12—Difference in grafting effect between soaking substrate in BP and pre-treatment with UV/O: A) Soaking with BP; and B) UV ozone pre-treatment.

A specimen of polypropylene nonwoven 250 μm thick and of dimension 2×4 cm was soaked in 100 mM benzophenone (~2%) in methanol for 18 hours. Immediately after soaking, it was sandwiched between two glasses with 20% GMA and benzophenone (I:M=1:25) in butanol solution. The time for the grafting polymerization was 15 minutes. Another polypropylene nonwoven was treated in the same way as in Example 1. All the samples were extracted in THF overnight and washed by methanol. FIG. 12 clearly shows that the substrate pre-treated by UV/O exhibits much higher density of graft than soaking in the benzophenone.

EXAMPLE 11

Layers of nonwoven in the thickness of 40-60 μm were skimmed from the PP nonwoven 250 μm thick. Five skimmed layers were restacked together to obtain a nonwoven of the similar thickness to the original nonwoven. To study the effect of light penetration, nonwovens of different thicknesses were prepared. A UV sensor was placed on one side of the nonwoven stack with the sensor surface covered by the nonwoven and the UV lamp was placed the opposite side. The whole system was placed in an enclosure with the inside covered by black foil to avoid exposure to light from the surroundings. The distance between the sensor and light source were adjusted to obtain the desired initial intensity for each test.

Figure 13:
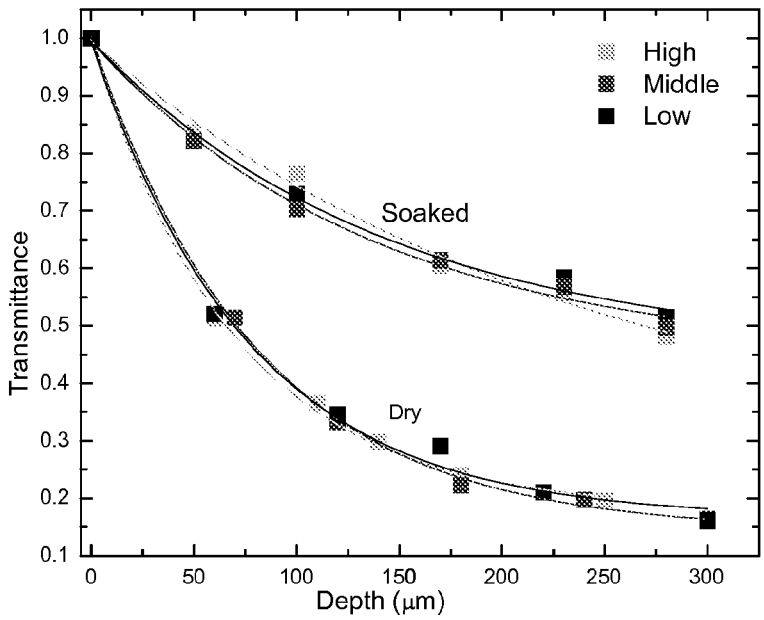
FIG. 13—Transmittances of UV light through the dry PP nonwoven stack and PP nonwoven stack soaked with monomer solution.

FIG. 13 shows the transmittances of UV light through dry nonwoven and nonwoven soaked with monomer solution. It comes as a surprise that when the nonwoven fabric is soaked with monomer solution, its light intensity decays much more slowly than under the dry condition. Since the monomer solution is able to absorb UV light, it would have been a reasonable expectation that UV intensity should decay faster. The slowdown of the decay is actually related a phenomenon known as index matching. Basically, as the refractory index of the solvent is closer to that of substrate as compared to air, it can reduce the Fresnel reflection at the surface, and thus increase the net light transmission. The refractory index of PP is 1.471 [13], that for butanol is 1.397 [13] and that for air is ~1.

Figure 14:
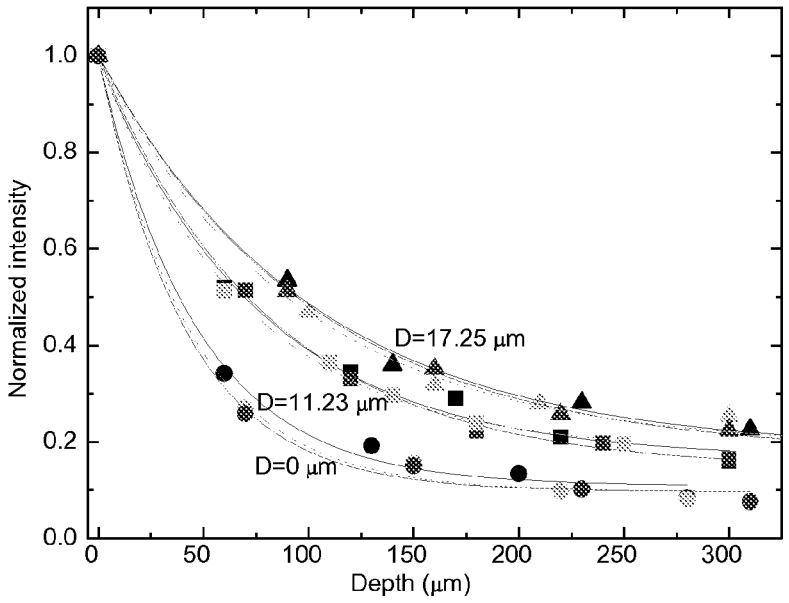
FIG. 14—Transmittances of UV light through PP nonwovens of different pore sizes.

Nonwovens made of the same material, but with different average pore sizes, show different penetration profiles. In FIG. 14, as the average pore size decreases from 17.25 to 0 μm, the decay of the UV intensity versus depth increases.

Figure 15:
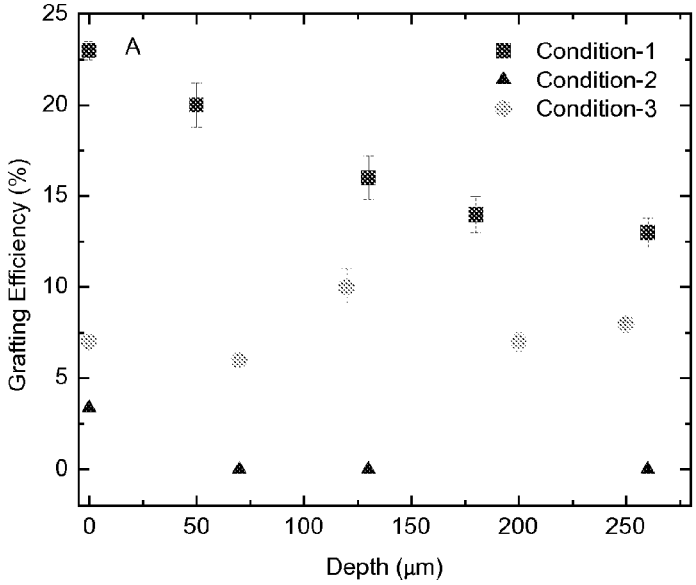
FIG. 15—Variation of grafting efficiency depending on the pre-treatment as a function of positions inside the nonwoven.
Figure 16:
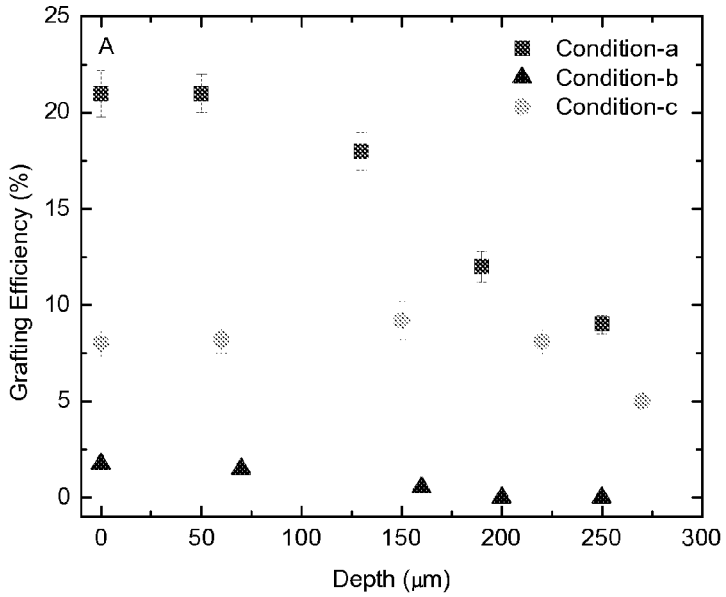
FIG. 16—Variation of grafting efficiency depending on grafting as a function of position inside the nonwoven.

Due to the decay of UV light through the nonwoven, grafting efficiency may also vary depending on the intensity of UV light exposed in both pre-treatment and grafting step. FIG. 15 shows the spatial variation of grafting efficiency caused by pre-treatment. FIG. 16 shows the spatial variation of grafting efficiency caused by grafting. Two controls, grafting with pre-treatment but without benzophenone (condition 2, b) and grafting without pre-treatment but with benzophenone (condition 3, c) are also plotted.

The plots of condition 1, a clearly show that the grafting efficiencies decreases as the depth increases. The plot of condition 2, b show only nominal grafting. These results indicate that without benzophenone grafting efficiencies are very low. If the nonwovens are not pre-treated, such as for condition 3, c, the spatial variation of grafting efficiencies is less than the treated nonwovens. But their grafting efficiencies are also much lower than those with pre-treatment.

The above-described embodiments of the invention are intended to be examples only. Variations, alterations and modifications can be made to the particular embodiments described herein by those of skill in the art without departing from the scope of the invention, as defined in the appended claims.

REFERENCES

1. Anders, C, Hoecker, H, Klee, D, Lorenz, G, "Hydrophilic coating of surface of polymeric substrates," U.S. Pat. No. 5,871,823.
2. D. J. Carlsson, D. M. Wiles, "The photo-oxidative degradation of polypropylene. part-I photo-oxidation and photo-initialization processes," Polymer Reviews, 14, (1976), 65.
3. J. H. Adams, "Analysis of nonvolatile oxidation products of polypropylene. III. Photodegradation," Journal of polymer Science Part A-1, 8, (1970), 1279.
4. Moya; Wilson, "Porous membrane and process", U.S. Pat. No. 5,629,084.
5. Belfort, G, Crivello J, Pieracci, J, "UV-assisted grafting of PES and PSF membranes," PCT WO 02/28947 A1
6. Crivello, J C, Belfort, G, Yamagishi, Hideyuki, "Low fouling ultrafiltration and microfiltration aryl polysuifone," U.S. Pat. No. 5,468,390.
7. Charkoudian J "Compositions of a copolymer including a sulfone polymer," U.S. Pat. No. 5,883,150.
8. Zhang L L, Li H J, Li K Z, Li X T, Zhai Y Q, Mang Y L, "Effect of surface roughness of Carbon/Carbon composites on osteoblasts growth behaviour,", Journal of Inorganic Materials, 23, (2008), 341.
9. Porwal, P K, Hui, C Y, "Strength statistics of adhesive contact between a fibrillar structure and a rough substrate," Journal of the Royal Society Interface, 5, (2008), 441.
10. Fuller K N G, Tabor D, "Effect of surface-roughness on adhesion of elastic solids", Proceedings of the Royal Society of London Series A—Mathematical Physical and Engineering Sciences, 345, (1975), 327.
11. L. F. Vieira Ferreira, J. C. Netto-Ferreira, I. V. Khmelinskii, A. R. Garcia, S. M. B. Costa, "Photochemistry on surfaces: matrix isolation mechanisms study of interactions of benzophenone adsorbed on microcrystalline cellulose investigated by diffusion reflectance and luminescence techniques," Langmuir, 11, (1995), 231.
12. K. Matyjaszewski, P. J. Miller, N. Shukla, B. Immaraporn, A. Gelman, B. B. Luokala, T. M. Siclovan, G. Kickelbick, T. Valiant, H. Hoffmann, T. Pakula, "Polymers at interfaces: using atom transfer radical polymerization in the controlled growth of homopolymers and block copolymers from silicon surfaces in the absence of untethered sacrificial initiator," Macromolecules, 32, (1999), 8716.
13. Polymer Handbook Fourth Edition (J. Brandrup, E. H. Immergut. E. A. Grulke), John Wiley & Sons, 1999.

What is claimed is:

1. A process to modify a fiber surface of a polymer nonwoven substrate to obtain a conformal coating, comprising:

1) increasing roughness of a fiber surface and increasing the hydroxyl, carbonyl and any other oxygen containing group through exposure to UV in air at a wavelength between 150-300 nm, wherein said exposure to UV in air generates ozone;
2) soaking the substrate with a solution containing both a monomer and an initiator;
3) sandwiching the soaked substrate obtained from step 2 between two glasses;
4) exposing the substrate to UV or heat for grafting to form the conformal coating; and
5) washing and drying the substrate.

2. A process as defined in claim 1, wherein the polymer nonwoven substrate is polyolefin fiber, aramid fiber, cellulose fiber, polyamide fiber, polyester fiber, polyvinyl alcohol fiber, polyethylene naphthalate fiber, polyacrylonitrile fiber, polyurethane fiber, liquid crystal copolyester fiber, rigid rod fiber, or a combination thereof.

3. A process as defined in claim 1, wherein the polymer nonwoven substrate is a flat sheet, a roll or a stack.

4. A process as defined in claim 1, wherein the polymer nonwoven substrate is a staple or continuous fiber.

5. A process as defined in claim 4, wherein the polymer nonwoven substrate has round, triangle, square, or any irregular shapes of cross-sections.

6. A process as defined in claim 1, wherein said monomer is a bifunctional molecule which can polymerize via radical polymerization and provide functional groups chosen from hydroxyl, amine, carboxylic acid, aldehyde, formamide, pyridine, pyrrolidone, and epoxy.

7. A process as defined in claim 1, wherein said solution comprises a solvent selected from an alcohol or hydrocarbon which dissolves at least 0.5% of the monomer.

8. A process as defined in claim 1, wherein said initiator is a photosensitizer.

9. A process as defined in claim 8, wherein said photosensitizer is benzophenone, anthraquinone, or naphthoquinone.

10. A process as defined in claim 1, wherein said solution contains 0.5% to 20% by weight of monomer.

11. A process as defined in claim 1, wherein unreacted monomers or unattached homopolymers are removed by water, alcohol or hydrocarbon.

12. A process as defined in claim 1, wherein the polymer nonwoven substrate has a uniform or gradient distribution of a second polymer inside the nonwoven substrate.

13. A process as defined in claim 1, wherein the polymer nonwoven substrate is polypropylene (PP) fiber or polybutylene terephthalate (PBT) fiber.

14. A process to modify a fiber surface of a polymer nonwoven substrate to obtain a conformal coating, comprising:

1) increasing roughness of a fiber surface and increasing the hydroxyl, carbonyl and any other oxygen containing group through exposure to UV in air at a wavelength between 150-300 nm, wherein said exposure to UV in air generates ozone;
2) soaking the substrate with a solution containing both a monomer and an initiator;
3) sandwiching the soaked substrate obtained from step 2 between two glasses, wherein said sandwiching promotes, during subsequent grafting, formation of a saturated vapor phase near the surface of the substrate;
4) exposing the substrate to UV or heat for grafting to form the conformal coating; and
5) washing and drying the substrate.

* * * * *